US011517911B2

(12) United States Patent
Schiffer et al.

(10) Patent No.: US 11,517,911 B2
(45) Date of Patent: Dec. 6, 2022

(54) COMMINUTION DEVICE WITH CONTROLLABLE PULL-IN MECHANISM

(71) Applicant: Manuel Lindner, Spittal an der Drau (AT)

(72) Inventors: Peter Schiffer, Millstatt (AT); Mario Fritz, Millstatt (AT)

(73) Assignee: Manuel Lindner, Spittal an der Drau (AT)

( * ) Notice: Subject to any disclaimer, the term of this patent is extended or adjusted under 35 U.S.C. 154(b) by 221 days.

(21) Appl. No.: 16/636,311

(22) PCT Filed: Jul. 26, 2018

(86) PCT No.: PCT/EP2018/070364
§ 371 (c)(1),
(2) Date: Feb. 3, 2020

(87) PCT Pub. No.: WO2019/025297
PCT Pub. Date: Feb. 7, 2019

(65) Prior Publication Data

US 2020/0306764 A1 Oct. 1, 2020

(30) Foreign Application Priority Data

Aug. 3, 2017 (EP) ..... 17184668

(51) Int. Cl.
*B02C 18/00* (2006.01)
*B02C 18/22* (2006.01)
(Continued)

(52) U.S. Cl.
CPC ..... *B02C 18/2291* (2013.01); *B02C 18/0084* (2013.01); *B02C 18/2233* (2013.01);
(Continued)

(58) Field of Classification Search
CPC ..... B02C 18/2291; B02C 18/0084; B02C 18/2233; B02C 2018/162; B02C 2018/188; B02C 25/00
(Continued)

(56) References Cited

U.S. PATENT DOCUMENTS 2,756,002 A * 7/1956 Brake ..... B02C 13/282 241/285.3
3,756,519 A * 9/1973 Reynolds ..... B02C 18/14 241/73
(Continued)

FOREIGN PATENT DOCUMENTS

CN 104858024 A 8/2015
DE 29915606 U1 12/1999
(Continued)

OTHER PUBLICATIONS

Office Action issued by the Japanese Patent Office for Japanese Patent Application No. dated Feb. 16, 2021.
(Continued)

*Primary Examiner* — Faye Francis
(74) *Attorney, Agent, or Firm* — Moore & Van Allen PLLC; Henry B. Ward, III

(57) ABSTRACT

The comminution device includes a feed opening for feeding material to be comminuted, a comminution shaft for comminuting the material fed to the device, and a cutting chamber, arranged between the feed opening and the comminution shaft and delimited by a cutting chamber wall, which can be pivoted.

9 Claims, 7 Drawing Sheets

(51) Int. Cl.
*B02C 18/16* (2006.01)
*B02C 18/18* (2006.01)

(52) U.S. Cl.
CPC .. *B02C 2018/162* (2013.01); *B02C 2018/188* (2013.01); *B02C 2201/06* (2013.01)

(58) Field of Classification Search
USPC ..... 241/280
See application file for complete search history.

(56) References Cited

U.S. PATENT DOCUMENTS

| | | | | |
|---|---|---|---|---|
| 4,198,005 | A * | 4/1980 | Eiff | B02C 18/144 241/285.3 |
| 4,394,984 | A * | 7/1983 | Hight | B02C 18/143 241/278.1 |
| 5,248,100 | A | 9/1993 | Arakawa | |
| 5,273,218 | A * | 12/1993 | Burns | B02C 18/146 241/189.1 |
| 5,553,797 | A * | 9/1996 | Axelsson | B02C 18/148 241/285.3 |
| 5,695,134 | A * | 12/1997 | Williams | B02C 13/288 241/186.3 |
| 6,016,979 | A * | 1/2000 | Squires | B02C 18/145 241/280 |
| 7,021,576 | B2 * | 4/2006 | Poeltinger | B02C 18/148 241/73 |
| 7,578,463 | B2 * | 8/2009 | Sotsky | B02C 18/145 241/224 |
| 7,766,263 | B2 * | 8/2010 | Karlsson | B02C 18/148 241/73 |
| 7,926,753 | B2 * | 4/2011 | Carver | B02C 18/0007 241/99 |
| 8,033,487 | B2 * | 10/2011 | Yamashita | B02C 18/146 241/73 |
| 8,505,843 | B2 * | 8/2013 | Veneroso | B02C 13/20 241/285.3 |
| 10,456,790 | B2 * | 10/2019 | Hengl | B02C 18/2233 |
| 2012/0018555 | A1 | 1/2012 | Schiffer | |
| 2015/0060583 | A1 * | 3/2015 | Boehlefeld | B02C 18/24 241/167 |
| 2015/0129697 | A1 * | 5/2015 | Berglitsch | B02C 18/2291 241/220 |
| 2015/0158030 | A1 | 6/2015 | Lindner | |

FOREIGN PATENT DOCUMENTS

| | | | |
|---|---|---|---|
| EP | 1371420 | A1 | 12/2003 |
| EP | 2857101 | A1 | 4/2015 |
| EP | 2857101 | B1 | 7/2015 |
| JP | 04008722 | U | 1/1992 |
| JP | 05023609 | U | 3/1993 |
| JP | 05070653 | U | 9/1993 |
| JP | 11090258 | A | 4/1999 |
| JP | 2005152877 | A | 6/2005 |
| WO | 2010094306 | A1 | 8/2010 |
| WO | 2011092588 | A1 | 8/2011 |

OTHER PUBLICATIONS

Office Action issued by the Chinese Patent Office for Chinese Application No. 201880046135.8 dated Nov. 19, 2020.
International Search Report for corresponding European PCT Application No. 2018/070364, dated Oct. 15, 2018, 10 pages.
European Search Report for corresponding European PCT Application No. 2018/070364, dated Feb. 12, 2018, 5 pages.
Written Opinion for corresponding European PCT Application No. 2018/070364, dated Oct. 15, 2018, 5 pages.
Office Action issued by the Korean Patent Office for Korean Patent Application No. 10-2020-7003235, dated Aug. 30, 2021.

* cited by examiner

COMMINUTION DEVICE WITH CONTROLLABLE PULL-IN MECHANISM

CROSS-REFERENCE TO RELATED APPLICATIONS

This patent application is a national phase application of PCT Application No. PCT EP2018/070364, filed Jul. 7, 2019, which claims the benefit of the filing date of European Patent Office patent application No. EP3437741, filed on Aug. 3, 2017, the disclosures of which are incorporated by reference herein.

FIELD OF THE INVENTION

The invention refers to a comminution device comprising a feed opening for feeding material to be comminuted, a comminution shaft for comminuting the fed material, and a cutting chamber arranged between the feed opening and the comminution shaft and delimited by a cutting chamber wall.

PRIOR ART

Commercial waste, industrial waste, household waste, etc., e.g. (hard) plastic, textiles, composites, rubber or waste wood (such as pallets and chipboards) require comminution before they are finally disposed of or, in particular, before they are returned to the recycling cycle. Single-shaft or multi-shaft comminutors, which are for example fed by wheel loaders, forklifts or conveyor belts via a hopper for material feed, are particularly well known in the prior art for comminuting such waste.

A conventional comminutor comprises a rotor unit in a cutting chamber, which rotor unit comprises one or more comminution shafts equipped with ripping hooks or knives. The knives are for example fastened by screwing to knife carriers which can be welded into knife pockets or for example screwed on, which are milled into the comminution shaft. The comminution of the fed material takes place between the knives rotating with the comminution shaft and stationary, i.e. non-rotating, counter knives (stator knives, scraper combs). The rotor unit is driven by a motor (e.g. combustion engine/electric motor).

A conventional comminutor can also include a secondary presser that pushes or presses the fed material in the direction of the rotating rotor. After comminution between the rotating knives and the counter knives, the material can be discharged through a sieving device (if present), which determines the comminution factor according to the size of the sieve, and can be transported further by using a conveyor belt, a transport screw, a chain conveyor or an extraction system, etc. Material that is still too large is returned to the cutting chamber by the rotation.

For an efficient comminuting performance, it is of great importance to feed the material permanently to the cutting area. There are substantially two different approaches here:

Flat Cutting Chamber Wall

Some comminution devices have at least one flat cutting chamber wall, which delimits the cutting chamber on one side, in conjunction with a pressing system or secondary pressing system, which presses the material towards the rotor or counter knife. This can be, for example, a kind of pusher or a screw conveyor. Flat means that the cutting chamber wall near the comminution shaft has a small angle to the horizontal (e.g. within +1-20°).

The advantage here is that by reducing the pressure force of the secondary presser, even materials that are difficult to comminute can be comminuted without the machine coming to a standstill due to overload. However, the disadvantage is that the throughput capacity of the machine decreases considerably during the time during which the secondary presser retracts. On the other hand, materials that are easy to comminute require a great deal of force and thus also energy from the secondary presser in order to achieve high throughput rates.

Steep Cutting Chamber Wall

Other comminution devices work with a steep, in extreme cases even vertical, cutting chamber wall, whereby the material slides automatically to the cutting area due to its own weight, resulting in a great pull-in action. In addition, a secondary presser can be installed. Steep means that the cutting chamber wall near the comminution shaft has a large angle (e.g. greater than 45°) to the horizontal. If the cutting chamber wall is curved upwards, an even greater angle to the horizontal can then be provided at an upper end of the cutting chamber wall.

The throughput rate of a material averaged over a predetermined period of time without secondary pressing can be designated as pull-in mechanism or action.

A more constant throughput capacity/throughput rate is here advantageous, since the material slides permanently to the cutting area. A disadvantage is that the comminution of materials that are difficult to comminute (e.g. solid and/or coarse materials) is not possible at all, or only by increased force or energy expenditure of the rotor, or a permanently low dosage of the feed material.

DESCRIPTION OF THE INVENTION

It is the object of the invention to at least mitigate the disadvantages in the case of a steep cutting chamber wall with pull-in action of the material. The comminution device according to the invention is suitable for waste as described above in connection with the prior art.

The object is achieved by a comminution device comprising a feed opening for feeding material to be comminuted into a cutting chamber; at least one comminution shaft for comminuting the fed material, wherein the cutting chamber is arranged between the feed opening and the comminution shaft and delimited by cutting chamber walls, and wherein at least one cutting chamber wall is pivotable to thereby control the pull-in action of the fed material to the comminution shaft based on the fed material's own weight; and a control device for adjusting a pivoting angle of the at least one cutting chamber wall, wherein the control device controls the pivoting angle during operation of the comminution device depending on at least one selected from the group consisting of (1) a load applied to the comminution shaft; (2) a torque applied to the comminution shaft; (3) a current supplied to an electric motor driving the comminution shaft; (4) a hydraulic pressure supplied to a hydraulic motor driving the comminution shaft; and (5) an operating condition of an internal combustion engine driving the comminution shaft; and wherein the pivoting angle is adjusted in such a way that the pull-in action is reduced based on an increase in at least one selected from the group consisting of the load, the torque, the current, and the hydraulic pressure, respectively.

The comminution device according to the invention comprises a feed opening for feeding material to be comminuted, a comminution shaft for comminuting the fed material, and a cutting chamber arranged between the feed opening and the comminution shaft and delimited by a cutting chamber wall. The comminution device according to the invention is characterized in that the cutting chamber wall is pivotable.

The advantage of the comminution device according to the invention is that by pivoting the cutting chamber wall, the pull-in action of the fed material to the comminution shaft, which is based on its own weight, can be controlled.

The waste comminution device according to the invention can be further developed as follows.

The at least one cutting chamber wall can be pivoted during operation of the comminutor, in particular it is pivotable in an automatically controlled manner. In addition, or as an alternative, the at least one cutting chamber wall may be pivotable outside the operation of the comminution device, in particular manually pivotable.

Another development consists in the fact that the cutting chamber wall may be pivotable about a pivot axis parallel or substantially parallel to a rotation axis of the comminution shaft, in particular wherein the pivot axis may be provided at a lower end of the cutting chamber wall. Substantially parallel means that the angle between the direction (or direction vector) of the rotation axis of the comminution shaft and the direction (or direction vector) of the pivot axis is 10° or less, preferably 5° or less, most preferably 2° or less. The angle between the axes is therefore also defined for skew axes as the angle between the direction vectors. In this way, the cutting chamber wall can be placed close to the comminution shaft and/or the comminution shaft is uniformly fed along the axis or along the comminution shaft.

According to another development, the comminution device may also include a pressing device for pressing the material to be comminuted against the comminution shaft. The pressing device allows the material to be comminuted to be temporarily pressed against the comminution shaft with increased pressure to increase throughput.

A further development is that the pressing device can be pivoted together with the cutting chamber wall. This has the advantage that the relative position of the pressing device in relation to the cutting chamber wall is maintained (remains constant) when the cutting chamber wall is pivoted.

According to another development, the pressing device can be rotated around a rotary axis, in particular the rotary axis can be arranged parallel or substantially parallel to the pivot axis but offset to it. Substantially parallel means that the angle between the direction (or the direction vector) of the rotary axis and the direction (or the direction vector) of the pivot axis is 10° or less, preferably 5° or less, most preferably 2° or less.

The cutting chamber wall may comprise a cylindrical section therein, and the rotary axis of the pressing device may be arranged in the central axis of the cylinder. In this way it is possible for the pressing device to be at a constant distance from the cutting chamber wall during rotation of the pressing device relative to the cutting chamber wall.

According to another development, the comminution device may also include a control device for adjusting a pivoting angle of the cutting chamber wall. This allows the pivoting angle to be automatically adapted to the material to be comminuted during operation of the comminution unit.

This can be further developed in such a way that the control device adjusts the pivoting angle during the operation of the comminution device depending on a load applied to the comminution shaft and/or a torque applied to the comminution shaft and/or a current supplied to an electric motor driving the comminution shaft and/or a hydraulic pressure supplied to a hydraulic motor driving the comminution shaft and/or an operating condition (e.g. rotational speed) of an internal combustion engine which drives the comminution shaft, in particular wherein the pivoting angle is adjusted in such a way that the pull-in action is reduced when the load and/or the torque and/or the current and/or the hydraulic pressure increase.

The above-mentioned object is also achieved by a method for operating a comminution device as disclosed herein.

The comminution device comprises a feed opening, a comminution shaft and a cutting chamber arranged between the feed opening and the comminution shaft and delimited by a cutting chamber wall. The method comprises the steps: feeding material to be comminuted into the feed opening and comminuting the fed material with the comminution shaft, wherein the method is characterized by pivoting the cutting chamber wall to control the pull-in action of the fed material to the comminution shaft based on its own weight.

According to a further development, the pivoting of the at least one cutting chamber wall can take place during the operation of the comminution device, in particular by automatically controlled pivoting; or the pivoting of the at least one cutting chamber wall can take place outside the operation of the comminution device, in particular by manual pivoting.

The method according to the invention can be further developed by the step of pressing the material to be comminuted against the comminution shaft.

Another development consists in the fact that the following further step may be provided: adjusting the pivoting angle during the operation of the comminution device depending on a load applied to the comminution shaft and/or a torque applied to the comminution shaft and/or a current supplied to an electric motor driving the comminution shaft and/or a hydraulic pressure supplied to a hydraulic motor driving the comminution shaft and/or an operating condition of an internal combustion engine driving the comminution shaft.

The pivoting angle can be adjusted in such a way that the pull-in action is reduced when the load and/or torque and/or current and/or hydraulic pressure increase.

Further features and exemplary embodiments as well as advantages of the present invention are explained in more detail hereinafter with reference to the drawing. It goes without saying that this embodiment cannot exhaust the entire scope of the present invention. It also goes without saying that some or all of the features described below can also be combined in other ways.

EMBODIMENTS

Figure 1:
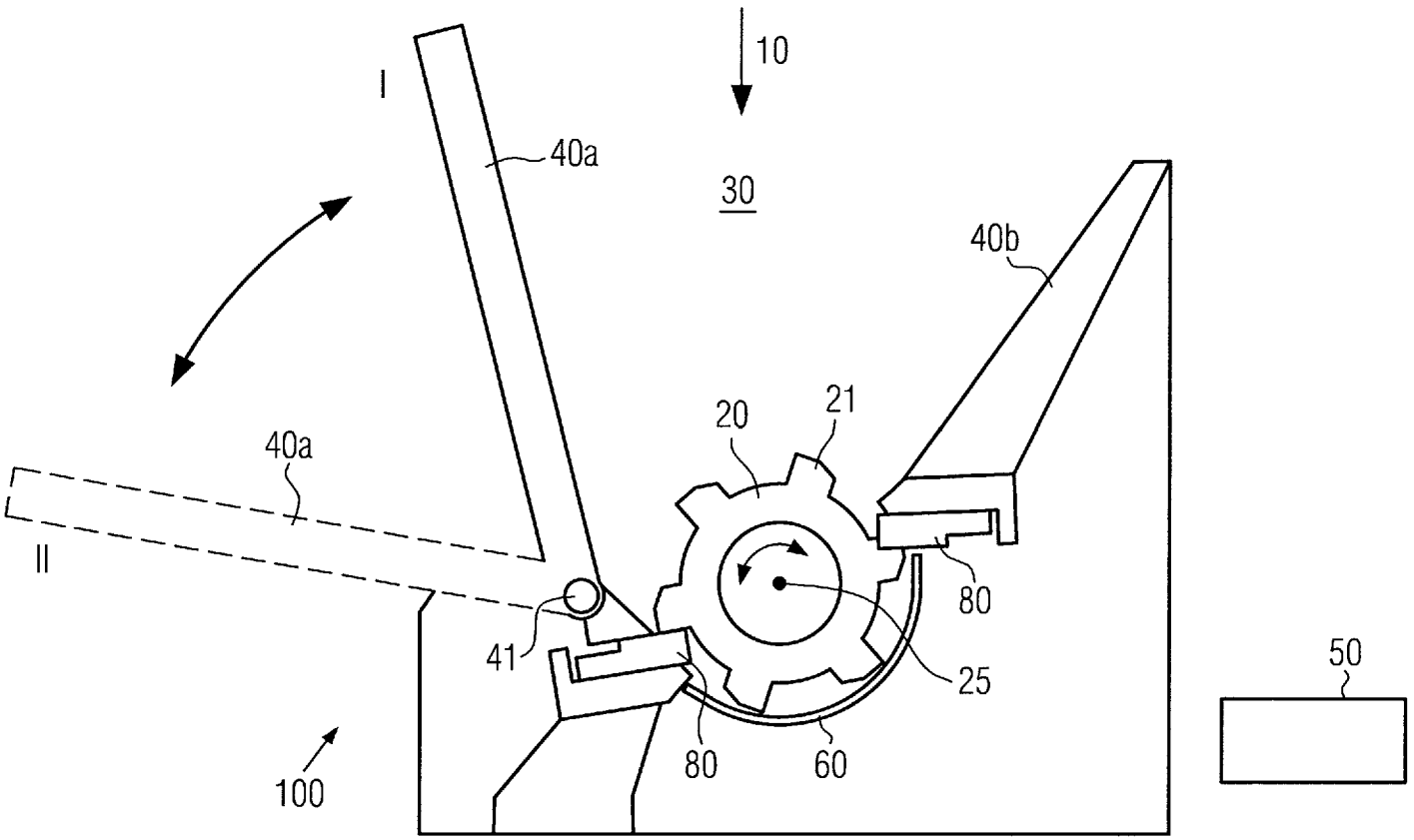
FIG. 1 shows a first embodiment of the comminution device according to the invention.

FIG. 1 shows a first embodiment of the comminution device according to the invention.

The first embodiment illustrated in FIG. 1 shows a comminution device 100 with a feed opening 10 for feeding material to be comminuted, a comminution shaft 20 for comminuting the fed material, and a cutting chamber 30 arranged between the feed opening 10 and the comminution shaft 20 and delimited by cutting chamber walls (shown is only a cutting chamber wall **40*a*** and a cutting chamber wall

40*b*, the two end walls are not shown). According to the invention, the cutting chamber wall 40*a* can be pivoted during operation of the comminution device 100. Here, the cutting chamber wall 40*a* is just exemplarily designed only partially as a flat wall. In this first embodiment, however, a differently shaped cutting chamber wall can also be used (such as the cylindrical shape according to the second embodiment described below).

The cutting chamber wall 40*a* in this embodiment can be pivoted about the pivot axis 41. The pivot axis 41 is parallel to the rotation axis 25 of the comminution shaft 20. The comminution shaft 20 comprises rotor knives 21. In addition to the comminution shaft 20 (several comminution shafts 20 can also be provided), stationary counter knives 80 are also located in the cutting chamber 30. By rotating the comminution shaft 20 around the rotation axis 25, the material is comminuted between the rotor knives 21 and the counter knives 80. An optional sieve 60 can be used to determine the size below which the comminuted material can leave the cutting chamber 30. The sieve 60 then represents the lower limit of the cutting chamber 30.

FIG. 1 shows a first position I, in which the cutting chamber wall 40*a* is arranged at a steep angle, and a second position II, in which the cutting chamber wall 40*a* is arranged at a flat angle. In position I, the pull-in action of the material is greater than in position II due to its own weight. In this way, the throughput of the comminution device can be controlled. Furthermore, an adaptation to the material to be comminuted can take place. In particular, in the case of a temporarily increased power supply to a motor (not shown) of the comminution shaft 20, a flatter angle can be set due to a temporary supply of coarser material in order to reduce the further supply of the material.

A control device 50 is provided for adjusting a pivoting angle of the cutting chamber wall 40*a*. The control device 50 adjusts the pivoting angle during operation of the comminution device 100 depending on a load applied to the comminution shaft 20 and/or a torque applied to the comminution shaft 20 and/or a current supplied to an electric motor driving the comminution shaft 20. The pivoting angle is adjusted in such a way that the pull-in action is reduced when the load and/or the torque and/or the current increase, so that the angle of the cutting chamber wall 40*a* is reduced/flattened in relation to the horizontal.

FIG. 2 shows a second embodiment of the comminution device according to the invention.

The second embodiment of the inventive comminution device 200 shown in FIG. 2 further comprises, in contrast to the first embodiment of the comminution device 100 according to the invention, a pressing device 90 for pressing the material to be comminuted against the comminution shaft 20. The cutting chamber wall 40*a* is here made cylindrical at least partially. The pressing device 90 can be rotated around a rotary axis 91. This rotary axis 91 also represents the symmetry axis of the cylindrical section of the cutting chamber wall 40*a*. The rear cutting chamber wall consists of two axially adjacent parts 40*c* and 40*d* (which, for example, are perpendicular to the rotary axis 91), wherein the part 40*d* is connected to the cutting chamber wall 40*a* and is pivoted together with the cutting chamber wall 40*a*.

Figure 2A:
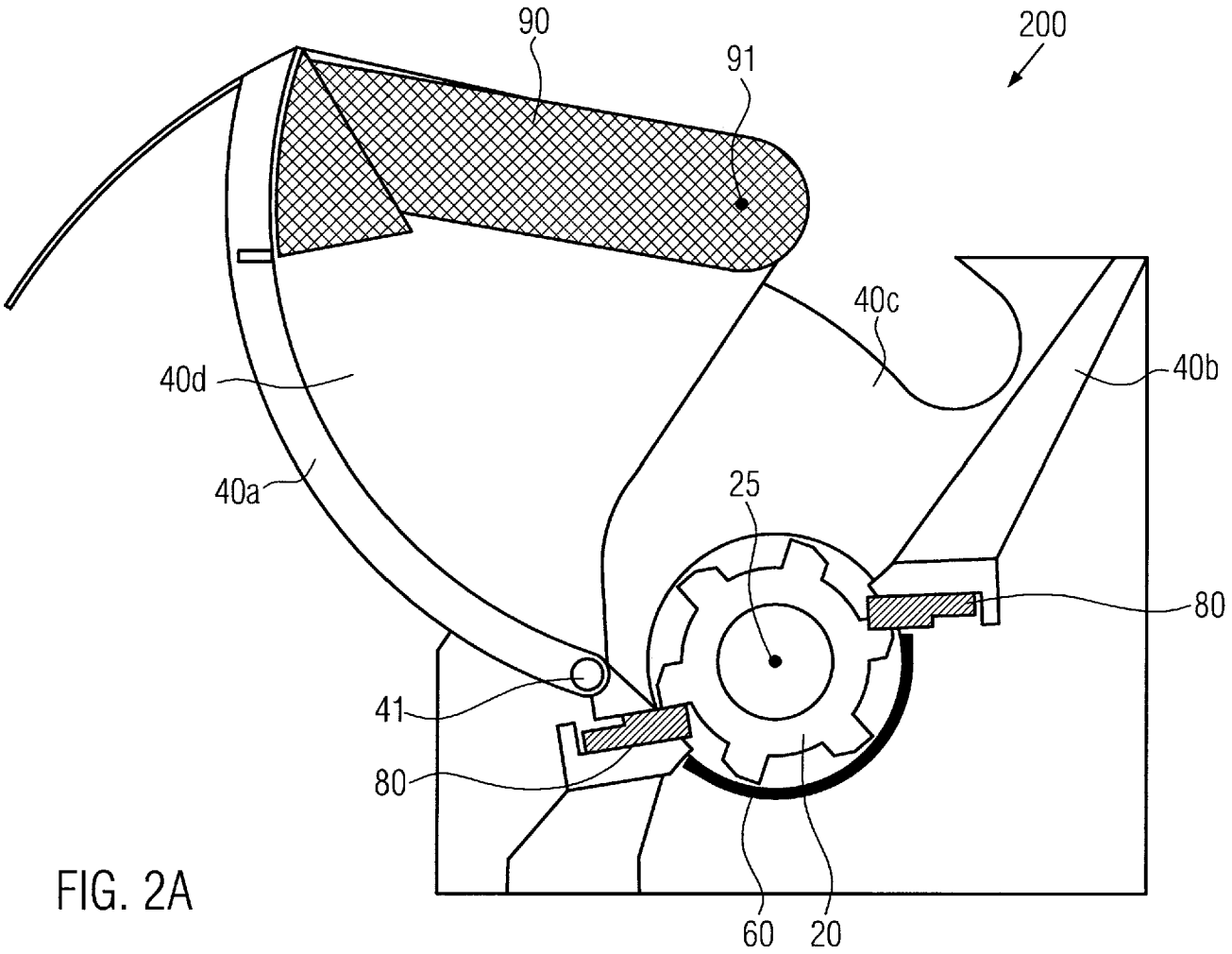
FIG. 2 shows a second embodiment of the comminution device according to the invention.
Figure 2B:
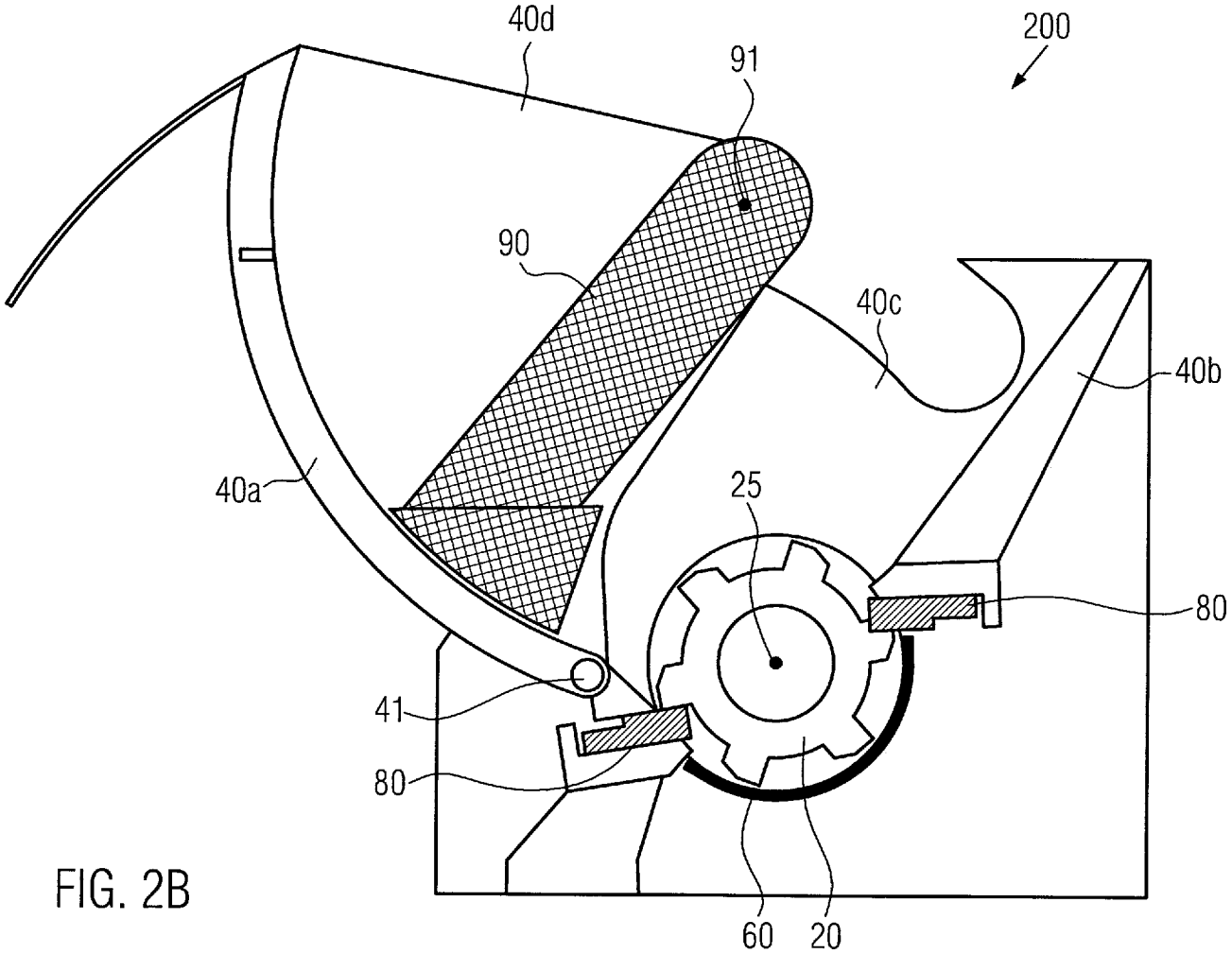

FIG. 2A shows a sectional view of the comminution device, with the pressing device 90 shown in a raised position. In FIG. 2B, the pressing device 90 is in a lowered position and presses the material to be comminuted against the comminution shaft 20.

Figure 2C:
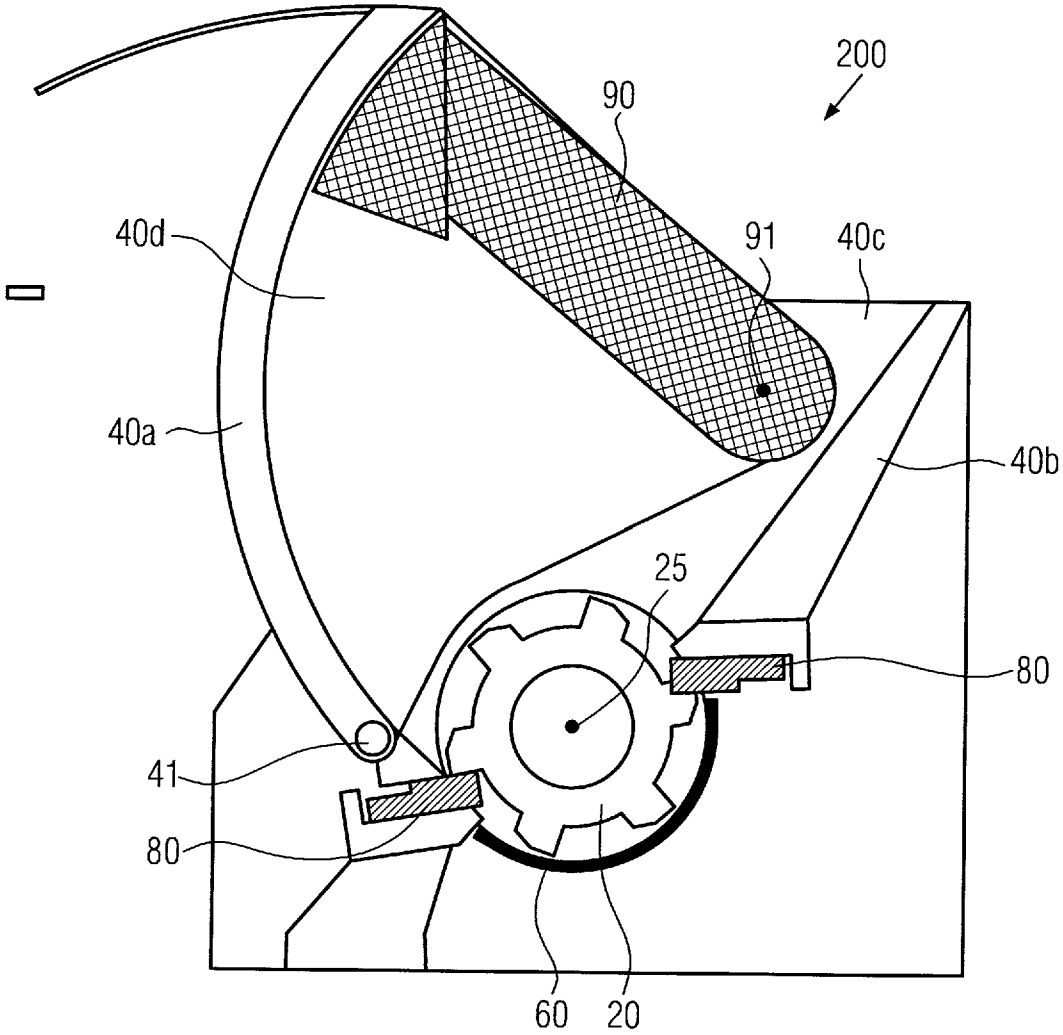
Figure 2D:
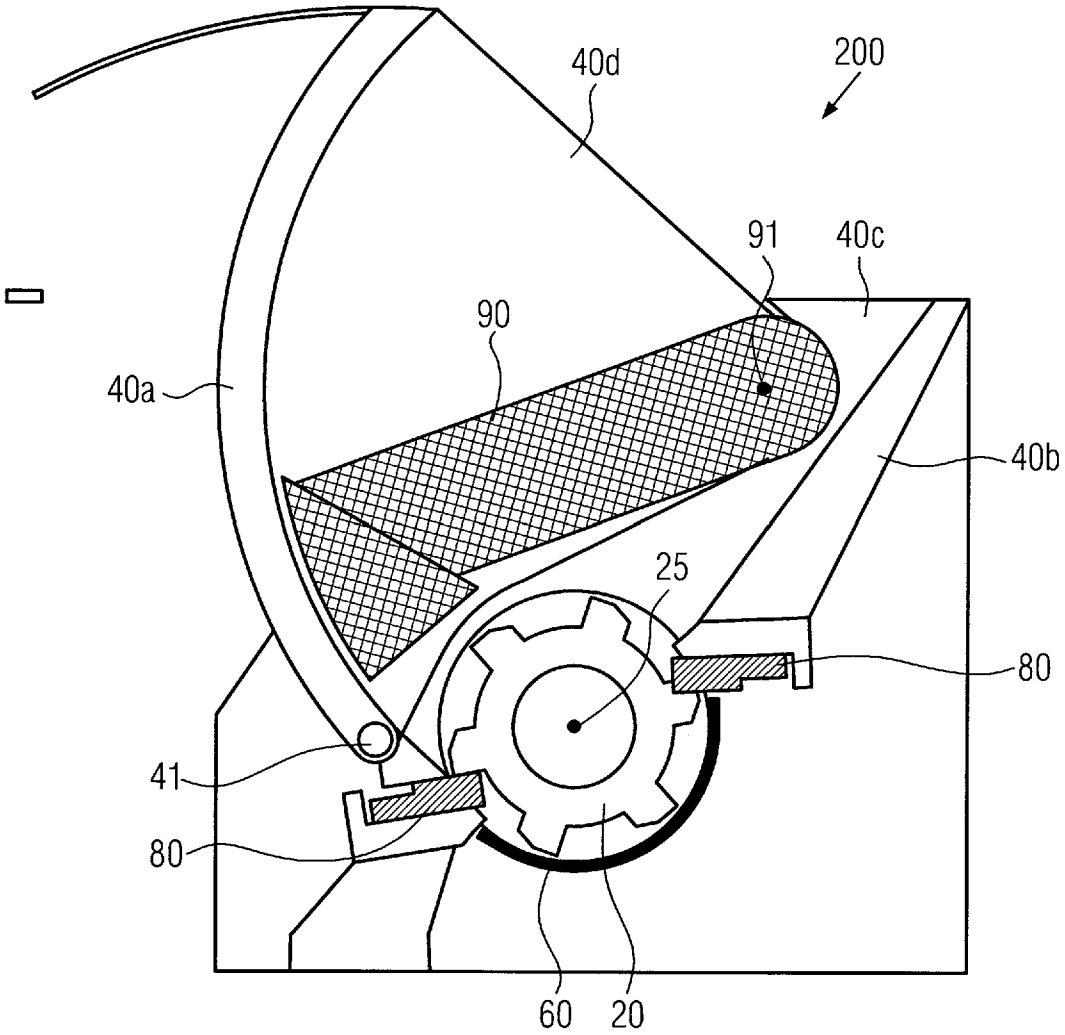

FIGS. 2C and 2D show the corresponding positions of the pressing device 90, but the unit of cutting chamber wall 40*a* and pressing device 90 is pivoted about the pivot axis 41, so that the cutting chamber wall 40*a* is steeper and a greater pull-in action is thus effected.

Figure 2E:
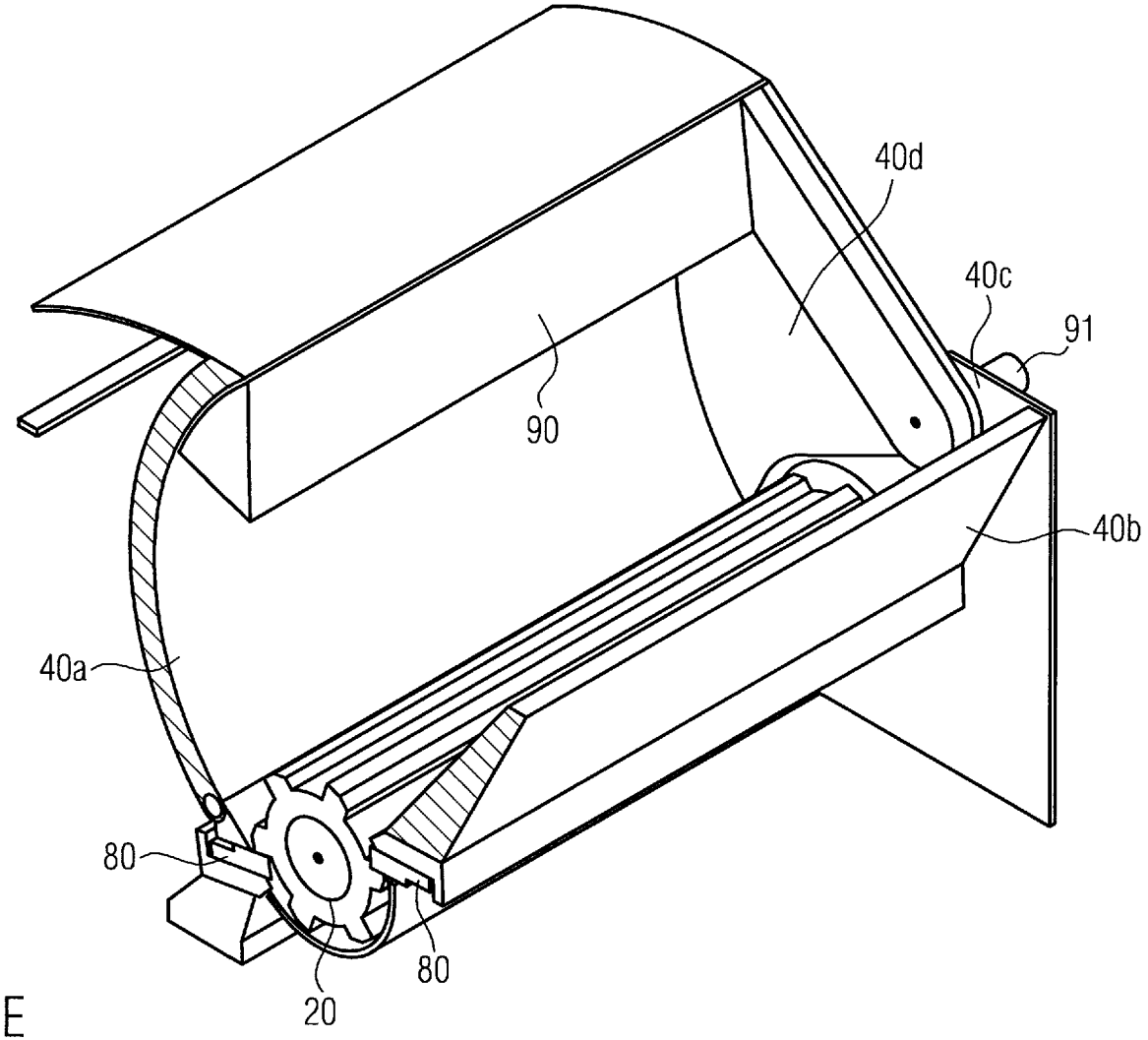
Figure 2F:
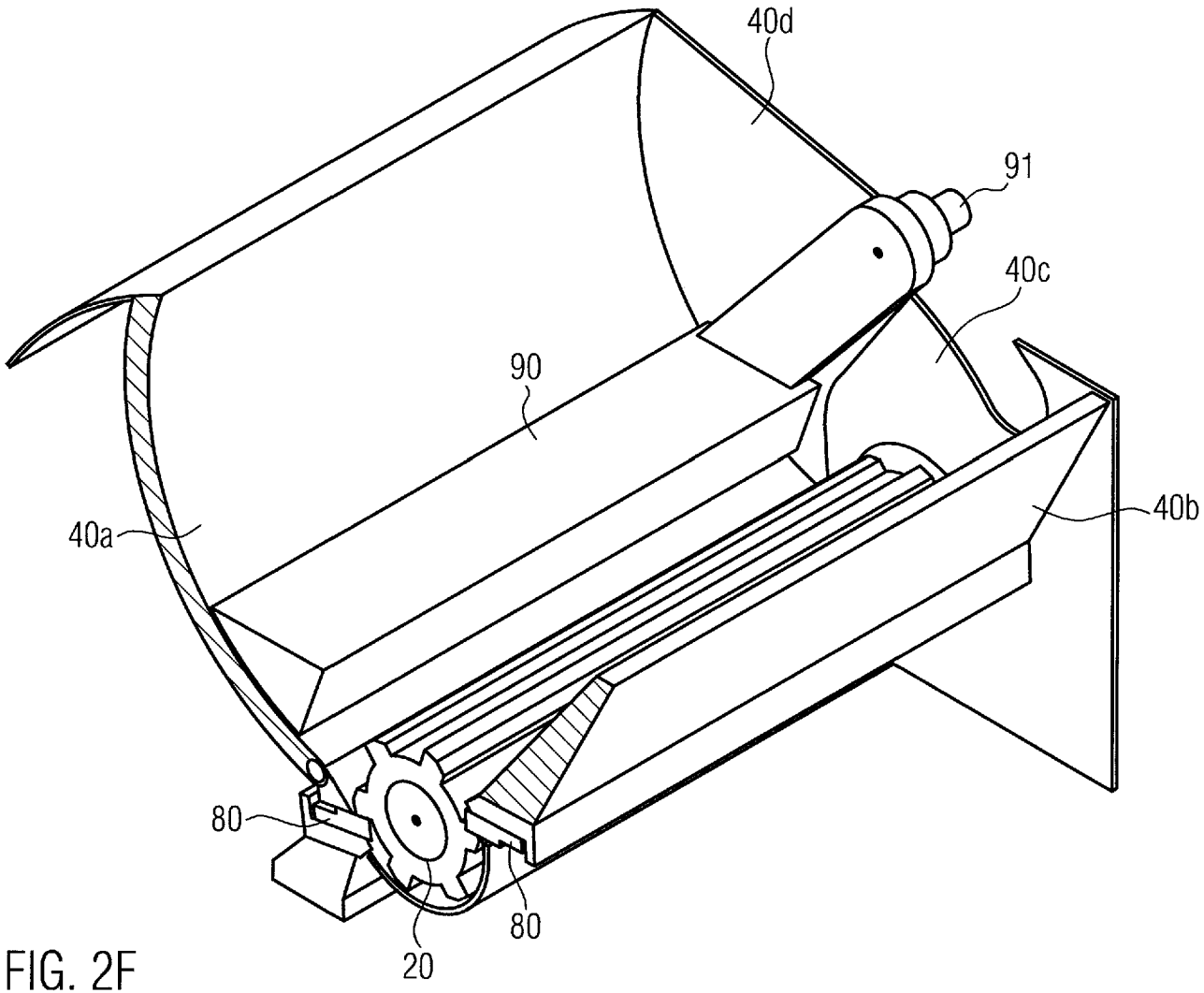

FIGS. 2E and 2F show perspective views of FIGS. 2C and 2B respectively.

However, since these are also sectional views, the front cutting chamber wall (which, like the rear cutting chamber wall 40*c*, 40*d*, consists of two parts) is not shown.

In summary: The cutting chamber wall 40*a* is not made rigid, but pivotable, so that the pull-in action can be changed during operation. The control unit 50 detects how much pull-in action is optimal for the current material. On the one hand, this makes the comminution device 100 more flexible as it can adapt to a wide variety of materials. On the other hand, many materials are comminuted more consistently, resulting in an increase in throughput.

The embodiments shown are only exemplary and the complete scope of the present invention is defined by the claims.

The invention claimed is:

1. A comminution device comprising:

a feed opening for feeding material to be comminuted into a cutting chamber;

at least one comminution shaft for comminuting the fed material, wherein the cutting chamber is arranged between the feed opening and the comminution shaft and delimited by cutting chamber walls, and wherein at least one cutting chamber wall is pivotable to thereby control the pull-in action of the fed material to the comminution shaft based on the fed material's own weight;

a control device for adjusting a pivoting angle of the at least one cutting chamber wall, wherein the control device controls the pivoting angle during operation of the comminution device depending on at least one selected from the group consisting of:

(1) a load applied to the comminution shaft;

(2) a torque applied to the comminution shaft;

(3) a current supplied to an electric motor driving the comminution shaft;

(4) a hydraulic pressure supplied to a hydraulic motor driving the comminution shaft; and (5) an operating condition of an internal combustion engine driving the comminution shaft; and wherein the pivoting angle is adjusted in such a way that the pull-in action is reduced based on an increase in at least one selected from the group consisting of the load, the torque, the current, and the hydraulic pressure, respectively; and a pressing device for pressing the material to be comminuted against the comminution shaft, wherein the pressing device is pivotable together with the at least one cutting chamber wall.

2. The comminution device according to claim 1, wherein the at least one cutting chamber wall is pivotable during operation of the comminution device or wherein the at least one cutting chamber wall is pivotable outside the operation of the comminution device.

3. The comminution device according to claim 1, wherein the at least one cutting chamber wall is pivotable about a pivot axis parallel or substantially parallel to a rotation axis of the comminution shaft and wherein the pivot axis is provided at a lower end of the at least one cutting chamber wall.

4. The comminution device according to claim 1, wherein the at least one cutting chamber wall is pivotable about a pivot axis parallel or substantially parallel to a rotation axis of the comminution shaft, wherein the pivot axis is provided at a lower end of the at least one cutting chamber wall, wherein the pressing device is rotatable about a rotary axis, and wherein the rotary axis is arranged parallel or substantially parallel to but offset from the pivot axis.

5. The comminution device according to claim 4, wherein the at least one cutting chamber wall comprises a partially cylindrical section and the rotary axis of the pressing device is arranged in the central axis of the cylinder with respect to the partially cylindrical section of the at least one cutting chamber wall.

6. The comminution device according to claim 1, wherein the at least one cutting chamber wall is pivotable about a pivot axis parallel or substantially parallel to a rotation axis of the comminution shaft, wherein the pivot axis is provided at a lower end of the at least one cutting chamber wall, wherein the pressing device is rotatable about a rotary axis, and wherein the rotary axis is arranged parallel or substantially parallel to but offset from the pivot axis.

7. The comminution device according to claim 6, wherein the at least one cutting chamber wall comprises a partially cylindrical section and the rotary axis of the pressing device is arranged in the central axis of the cylinder with respect to the partially cylindrical section of the at least one cutting chamber wall.

8. A method for operating a comminution device, the method comprising:

providing a comminution device comprising a feed opening, a comminution shaft, and a cutting chamber arranged between the feed opening and the comminution shaft and delimited by cutting chamber walls;

feeding material to be comminuted into the feed opening;

comminuting the fed material with the comminution shaft by pivoting at least one cutting chamber wall in order to control the pull-in action of the fed material to the comminution shaft based on the fed material's own weight;

adjusting the pivoting angle during operation of the comminution device depending on at least one selected from the group consisting of:

(1) a load applied to the comminution shaft;

(2) a torque applied to the comminution shaft;

(3) a current supplied to an electric motor driving the comminution shaft;

(4) a hydraulic pressure supplied to a hydraulic motor driving the comminution shaft; and (5) an operating condition of an internal combustion engine driving the comminution shaft, wherein the pivoting angle is adjusted such that the pull-in action is reduced based on an increase in at least one selected from the group consisting of the load, the torque, the current, and the hydraulic pressure, respectively; and pressing, by a pressing device, the material to be comminuted against the comminution shaft, wherein the pressing device is pivotable together with the at least one cutting chamber wall.

9. The method according to claim 8, wherein the pivoting step comprises:

pivoting the at least one cutting chamber wall during operation of the comminution device or pivoting the at least one cutting chamber wall outside the operation of the comminution device.

* * * * *